United States Patent [19]

Leupelt

[11] 4,195,302

[45] Mar. 25, 1980

[54] DOUBLE REFLECTOR ANTENNA WITH FEED HORN PROTECTION

[75] Inventor: Uwe Leupelt, Munich, Fed. Rep. of Germany

[73] Assignee: Siemens Aktiengesellschaft, Berlin & Munich, Fed. Rep. of Germany

[21] Appl. No.: 948,669

[22] Filed: Oct. 5, 1978

Related U.S. Application Data

[63] Continuation of Ser. No. 800,654, May 26, 1977, abandoned.

[30] Foreign Application Priority Data

Jun. 25, 1976 [DE] Fed. Rep. of Germany ..... 2628713

[51] Int. Cl.[2] ..... H01Q 1/02; H01Q 19/18

[52] U.S. Cl. ..... 343/704; 343/781 CA

[58] Field of Search ..... 343/781 P, 781 CA, 840, 343/704, 837

[56] References Cited

U.S. PATENT DOCUMENTS

| | | | |
|---|---|---|---|
| 2,298,272 | 10/1942 | Barrow | 343/784 |
| 3,235,870 | 2/1966 | Hannan | 343/781 CA |
| 3,286,267 | 11/1966 | Lutchansky | 343/781 CA |
| 3,295,136 | 12/1966 | Miller | 343/781 CA |
| 3,518,686 | 6/1970 | Siebecker | 343/755 |
| 3,641,577 | 2/1972 | Tocquec | 343/781 CA |
| 3,763,493 | 10/1973 | Shimada | 343/781 CA |
| 3,942,138 | 3/1976 | Schaedla | 343/784 |
| 3,995,275 | 11/1976 | Betsudan et al. | 343/781 CA |

FOREIGN PATENT DOCUMENTS

| | | | |
|---|---|---|---|
| 1410632 | 9/1975 | United Kingdom | 343/781 CA |

*Primary Examiner*—Eli Lieberman

*Attorney, Agent, or Firm*—Hill, Van Santen, Steadman, Chiara & Simpson

[57] ABSTRACT

A double reflector antenna mounted on a terrestrial mount with Azimuth and elevation shafts in which a primary field radiating and detecting horn is mounted within a housing behind a central opening of the main reflector dish so as to radiate and receive energy from a sub-reflector mounted at the focal point of the main reflector dish and such that the lead supplying energy to and from the horn can be very short and the horn can be substantially shielded from snow and rain.

1 Claim, 1 Drawing Figure

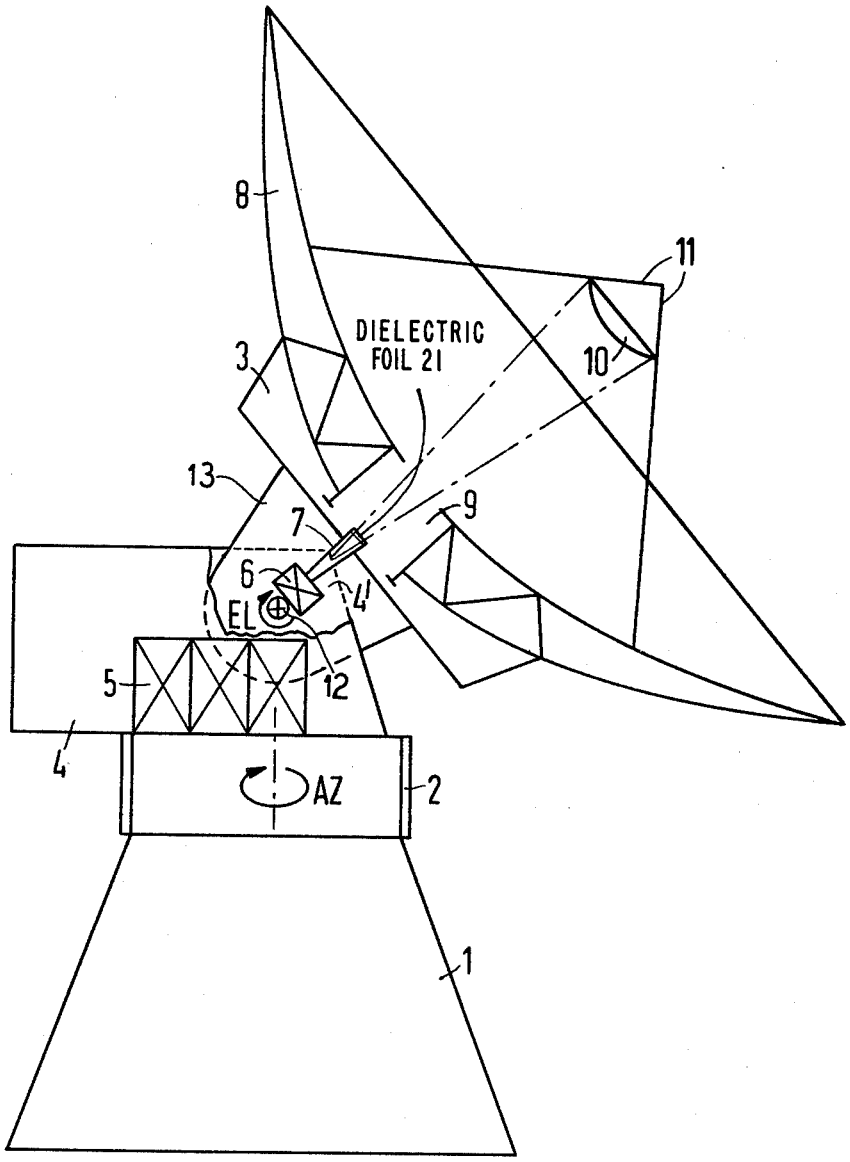
8
11
DIELECTRIC
FOIL 21
3
10
13
9
7
6
4'
EL
5
12
4
AZ
2
1

DOUBLE REFLECTOR ANTENNA WITH FEED HORN PROTECTION

This is a continuation, of application Ser. No. 800,654, filed May 26, 1977, now abandoned.

BACKGROUND OF THE INVENTION

1. Field of the Invention

This invention relates in general to a double reflector antenna and in particular to a Cassegrain or Gregory type antenna for the frequency range above 6 GHz.

2. Description of the Prior Art

Double reflector antenna which use a main reflector dish and a sub-reflector mounted at the focal point of the main reflector generally utilize a primary for field exciting means in the form of a small horn radiator which has its free end projecting through the central opening of the main reflector and is mounted between the main reflector and the sub-reflector. Such antenna are used for radio relay or satellite relay systems and a double reflector antenna of this type is described, for example, in the publication Siemens Zeitschrift, "Nachrichtenuebertragungstechnik" Supplement, 48th edition, 1974, pages 226 to 229.

Such arrangement of the primary for field radiator mounted between the main reflector and the sub-reflector requires necessarily that long supply lines be utilized between the radiator and the transmitting-receiving equipment which are generally contained in a housing behind the main reflector. The attenuation of wave-guide supply lines which are long gives rise to undesirable attenuation which is noticeable during transmitting operation. During receiving operations, the relatively high attenuation of the wave-guide supply line makes it necessary that the preliminary amplifier be mounted in the immediate vicinity of the feed point of the primary for field radiator and, for example, when a horn radiator is used inside the supporting structure of the reflector. Also such arrangement may produce an adequate reduction in the attenuation loss of the wave-guide supply line through the transmitting-receiving equipment for a receiving operation the access for servicing and assembly to the pre-amplifier is very poor.

The radiating opening of the primary far field radiator aperture must be protected from weather influences by means of a thin dielectric foil, but in the prior art devices it is directly exposed to rain or snow. At higher frequencies, layers or drops of water, snow and ice on the foil produce serious disturbances and impairment of the operating properties due to the reflection and absorption of the signal by the water, snow and ice. This becomes particularly disturbing in antenna which operate according to the principle of so-called frequency refuse systems. It has been learned from experience that the higher requirements which must be maintained in order to obtain the accuracy of the cross-polarization of the antenna so as to ensure satisfactory operation cannot be maintained under such conditions. For this reason, in the prior art it has been common practice to generally provide fans which keep the radiator opening free of water or snow deposits.

SUMMARY OF THE INVENTION

It is an object of the present invention to provide a double reflector antenna for use for radio relay or satellite relay systems for the frequency range above 6 GHz and in particular above 10 GHz which consists of a main reflector, a sub-reflector and a primary far field radiator particularly of a horn radiator type which substantially eliminates the problems which arise with prior art antennas of this type.

In the present invention, the primary far field radiator is mounted behind a central opening of the main reflector which arrangement allows for shorter feed supply lines to the field radiator and also provides shielding of the horn of the field radiator due to its mounting within the central opening of the main reflector.

The invention is based on the realization that in a double reflector far field antenna which operates at frequencies above 6 GHz and in particular above 10 GHz it is possible to arrange the primary remote field radiator in an extremely advantageous position at the rear of the main reflector and without thereby substantially increasing the dimensions of the primary remote field radiator. Such mounting arrangement substantially shortens the feed lines connections between the primary remote field radiator and the transmitting and receiving equipment. Also, the radiator opening is mounted behind the central opening of the main reflector dish such that the main reflector dish substantially screens the primary remote field radiator from rain and snow. Particularly, when conventional elevation angles of the base station antenna for satellite networks fall within the normal elevation angles of 20 to 60 degrees, such arrangement is very advantageous.

In a preferred embodiment, the input terminal of the receiving amplifier is mounted in the direct vicinity of the feed point of the primary remote field radiator. Such arrangement overcomes the poor accessibility of the amplifier of prior art devices and render the amplifier readily available for servicing and assembly.

Another advantage of the present invention is that by providing a structural combination of the primary far field radiator and the receiving amplifier allows the receiving amplifier to be mounted inside the equipment housing of the antenna and to allow the free end of the primary far field radiator horn to extend out of the housing for the transmitter and receiver through an opening formed for this purpose.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWING

The FIGURE is a schematic illustration of a Cassegrain antenna for a satellite base station designed according to the invention.

DESCRIPTION OF THE PREFERRED EMBODIMENT

The figure schematically illustrates a Cassegrain antenna for a satellite ground station according to the invention in which an antenna base 1 has mounted thereon a turntable 2 for movement about the Azimuth axis AZ. Mounted on the turntable 2 is a housing 4 and an antenna supporting structure 3. The device housing 4 contains the transmitting equipment 5 and the receiving amplifier 6 and the primary field radiator illustrated as a horn 7 is mounted in the housing 4 and has its end extending through an opening 4' formed in the housing 4. The elevation axis 12 for supporting the antenna support 3 extends through the housing 4 and passes through the extension 13 which is connected to the antenna support 3 as shown. The main reflector 8 is attached to the antenna support structure 3 and is rotatable about the elevation axis EL designated by the shaft 12. In the main reflector 8 is formed a central opening 9 behind which the horn 7 of the primary far field radiator radiates so as to stimulate the sub-reflector 10 mounted on a suitable supporting means 11 from the main reflector 8 as shown.

The end of the horn 7 is covered by a thin foil 21 so as to protect it from the weather such as rain and snow. Due to the substantial thickness of the opening 9, of the central portion of the main reflector 8, the opening of the horn 7 would be exposed to weather only at extremely high elevation angles and since antennas of this type are normally not operated above elevation angles of 60° generally the main reflector protects the horn 7 from exposure to rain and snow. For this reason, generally no special measures are required to keep the cover of the horn 7 free from rain and snow and such equipment required in the prior art can be eliminated with the present invention.

If it is necessary in very special circumstances to provide a fan such fan can be mounted in the frame of the main reflector 8 so as to provide very efficient and effective protection of the horn 7. As stated above, however, generally it is not required to provide a fan due to the protection of the horn provided by the opening 9 and the mounting arrangement of the horn 7 as shown in the Figure.

Although the invention has been described with respect to preferred embodiments, it is not to be so limited, as changes and modifications may be made which are within the full intended scope as defined by the appended claim.

I claim as my invention:

1. A double reflector rotation symmetrical antenna, such as a Cassegrain or Gregory antenna for the frequency range above 6 GHz and in particular above 10 GHz, installed in a satellite base station, comprising, a base member, an elevation shaft, a housing mounted on said base member, an antenna frame member rotatably supported on said elevation shaft, said elevation shaft supported by said housing, a primary reflector mounted on said frame member and formed with a central opening, a secondary reflector supported from said primary reflector and aligned with said central opening, and a primary field radiator mounted behind said primary reflector on said frame member to direct and receive radiant energy from said secondary reflector and including a receiving amplifier mounted within said housing and a radiating far field horn which on its end is covered with a thin dielectric foil to protect it from weather such as rain and snow and which extends from said housing toward said primary reflector which has substantial thickness at its center about said central opening and said horn terminates before the plane defined by the outer end of said central opening and is spared therefrom such that the walls of said central opening partially shield said horn from moisture such as rain, snow and ice.

* * * * *